US008155564B2

(12) United States Patent
Adachi et al.

(10) Patent No.: US 8,155,564 B2
(45) Date of Patent: Apr. 10, 2012

(54) IMAGE FORMING APPARATUS

(75) Inventors: Motoki Adachi, Ashigarakami-gun (JP); Yuji Kawaguchi, Mishima (JP); Shuhei Kawasaki, Mishima (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 12/548,349

(22) Filed: Aug. 26, 2009

(65) Prior Publication Data

US 2010/0054778 A1 Mar. 4, 2010

(30) Foreign Application Priority Data

Aug. 28, 2008 (JP) ..... 2008-220332
Aug. 19, 2009 (JP) ..... 2009-190451

(51) Int. Cl.
*G03G 15/01* (2006.01)

(52) U.S. Cl. ..... 399/227; 399/53; 399/54; 399/119; 399/226

(58) Field of Classification Search ..... 399/227, 399/53, 54, 119, 226
See application file for complete search history.

(56) References Cited

U.S. PATENT DOCUMENTS

| | | | | |
|---|---|---|---|---|
| 5,826,146 | A | 10/1998 | Maruta et al. | |
| 5,835,825 | A | 11/1998 | Maruta | |
| 6,546,220 | B1 * | 4/2003 | Asakura et al. | 399/227 |
| 2004/0057751 | A1 | 3/2004 | Matsuo et al. | |
| 2004/0184837 | A1 * | 9/2004 | Kinouchi | 399/227 |
| 2006/0039720 | A1 * | 2/2006 | Miyazawa et al. | 399/227 |

FOREIGN PATENT DOCUMENTS

| | | |
|---|---|---|
| EP | 1508840 | 2/2005 |
| EP | 1717642 | 11/2006 |
| JP | 11-15265 | 1/1999 |
| JP | 2005-148319 | 6/2005 |

* cited by examiner

*Primary Examiner* — Ryan Walsh
(74) *Attorney, Agent, or Firm* — Canon USA Inc IP Division

(57) ABSTRACT

In a rotary-type image forming apparatus, rotation of a rotary is temporarily stopped at a position where a coupling member and a drive transmission member are engageable with each other, and a developing roller is set in a rotating state. Subsequently, the rotary is rotated so as to bring the developing roller into contact with a surface of a photosensitive drum.

6 Claims, 11 Drawing Sheets

IMAGE FORMING APPARATUS

BACKGROUND OF THE INVENTION

1. Field of the Invention

The present invention relates to electrophotographic color image forming apparatuses that employ a rotary-method development process.

2. Description of the Related Art

In a full-color image forming apparatus of the related art that includes a single image bearing member and a rotatable support member integrally supporting a plurality of developing devices, the image forming apparatus employs a development process in which the developing devices are sequentially switched at a predetermined timing so as to develop an electrostatic latent image formed on the surface of the image bearing member.

An image forming apparatus that develops an electrostatic latent image formed on the surface of a single image bearing member by using a rotatable developing-device support member (i.e., a rotary) that integrally supports a plurality of developing devices in this manner to sequentially switch the developing devices is called a rotary-type image forming apparatus.

Japanese Patent Laid-Open Nos. 2005-148319 and 11-15265 disclose examples of such a rotary-type image forming apparatus of the related art.

Generally, in a rotary-method development process, it is necessary to sequentially bring toner bearing members, included in the developing devices provided in correspondence to toners of respective colors, into and out of contact with the surface of the image bearing member at a development position. The switching of the developing devices is performed by rotating the developing-device support member while the developing devices are set out of contact with the surface of the image bearing member.

In the image forming apparatus of the related art, the developing-device support member is moved in the radial direction (i.e., towards the center of rotation) of the image bearing member by using, for example, a cam having a driving force so as to bring the toner bearing member into and out of contact with the surface of the image bearing member.

As a drive transmission method of transmitting a driving force to the toner bearing member provided in each developing device, Japanese Patent Laid-Open No. 11-15265 discusses a method of transmitting a rotational driving force to the toner bearing member by joining a coupling in the developing device to a coupling in the main apparatus body.

In this case, the coupling in the main apparatus body is in a retreated state to prevent it from interfering with the rotation of the developing-device support member, and when the developing-device support member is rotated to a predetermined position from that state, the developing-device support member moves toward the coupling in the developing device so as to engage with the coupling in the developing device.

Therefore, a rotary-type image forming apparatus requires a time period for allowing the coupling in the developing device to engage with the coupling in the main apparatus body so that the toner bearing member can be rotated.

However, the rotary-type image forming apparatus of the related art has the following problems.

In the image forming apparatus of the related art, since the developing-device support member is configured to be moved in the radial direction of the image bearing member to bring the toner bearing member into and out of contact with the surface of the image bearing member, a space for moving the developing-device support member is necessary.

In addition, a cam, for example, is required as a driver for moving the developing-device support member in the radial direction of the image bearing member for performing the operation for moving the toner bearing member into and out of contact with the surface of the image bearing member.

In other words, the rotary-type image forming apparatus of the related art requires a driver as well as a space for entirely moving the developing-device support member in the radial direction of the image bearing member to bring the toner bearing member into or out of contact with the surface of the image bearing member. Therefore, it is difficult to achieve size reduction of the main apparatus body, as well as cost reduction.

As a countermeasure against such problems, the operation for moving the toner bearing member into and out of contact with the surface of the image bearing member may conceivably be performed by, for example, directly utilizing the rotation of the developing-device support member instead of using a driver, such as a cam.

However, if the operation for moving the toner bearing member into and out of contact with the image bearing member is to be performed by utilizing the rotation of the developing-device support member, it becomes difficult to ensure the time for engaging the coupling in the developing device with the coupling in the main apparatus body.

As a result, the toner bearing member comes into contact with the surface of the image bearing member before the two couplings engage with each other and the toner bearing member is rotationally driven. If the toner bearing member in a non-rotating state comes into contact with the surface of the image bearing member, the toner on the toner bearing member becomes scraped off by the image bearing member, creating a fog on the surface of the image bearing member and thus leading to an image defect.

SUMMARY OF THE INVENTION

The present invention provides a rotary-type image forming apparatus that allows for good image quality as well as a smaller main apparatus body and lower costs.

Further features of the present invention will become apparent from the following description of exemplary embodiments with reference to the attached drawings.

DESCRIPTION OF THE EMBODIMENTS

Preferred embodiments of the present invention will be described below in detail with reference to the drawings. It is to be noted however that the dimensions, materials, shapes and relative positions of components described in these embodiments are not to limit the scope of the invention, unless otherwise noted.

First Embodiment

An image forming apparatus according to a first embodiment of the present invention will now be described with reference to FIGS. 1 to 9.

Schematic Configuration of Image Forming Apparatus

Figure 1:
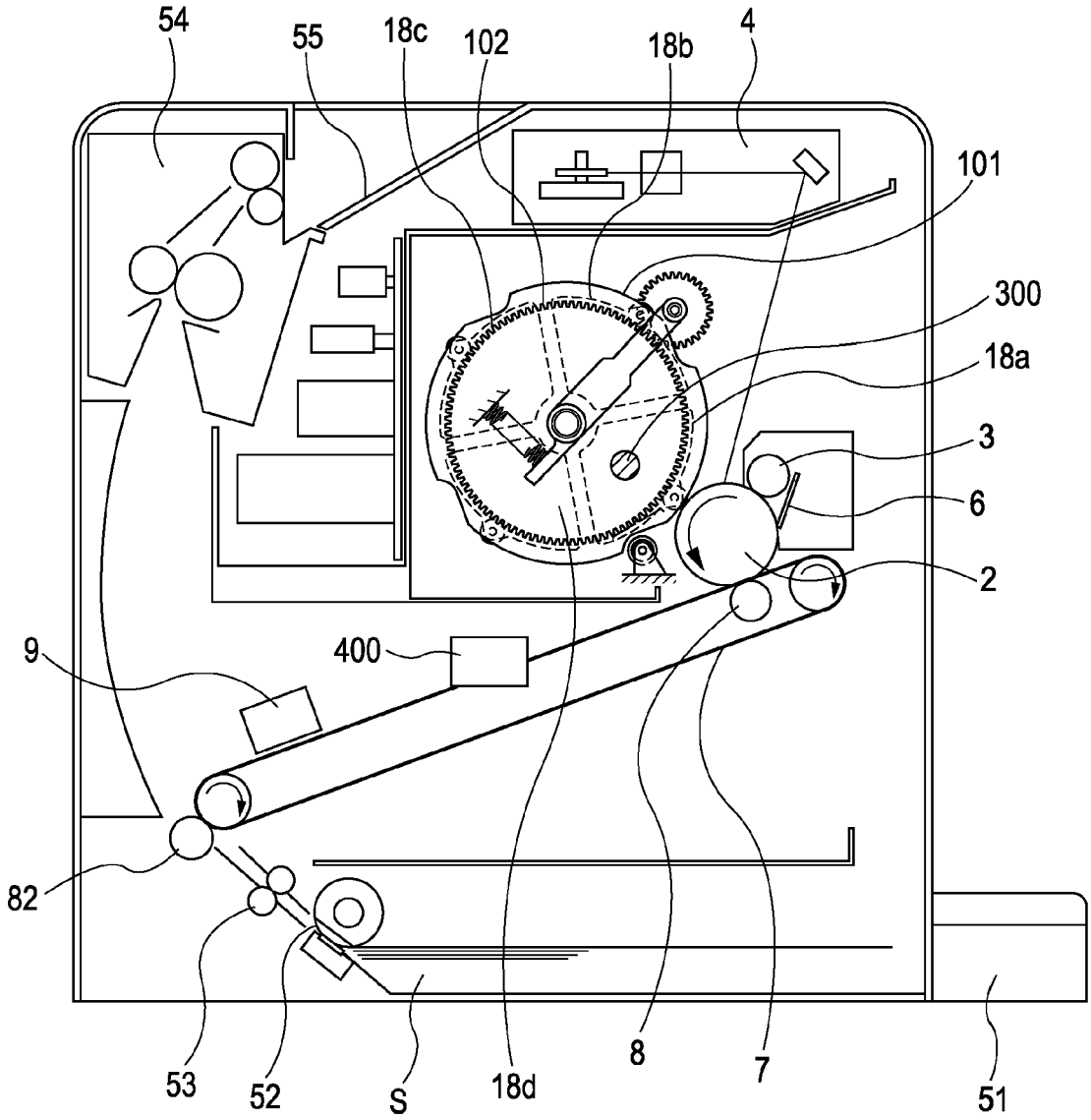
FIG. 1 schematically illustrates an image forming apparatus according to a first embodiment.

FIG. 1 schematically illustrates the image forming apparatus according to the first embodiment. In the first embodiment, a rotary-type (electrophotographic) color laser printer is used as the image forming apparatus.

The color laser printer includes a rotatable photosensitive drum (image bearing member) 2. The photosensitive drum 2 is surrounded by a charge roller 3 for uniformly charging the surface of the photosensitive drum 2, an exposure unit 4 for irradiating the surface of the photosensitive drum 2 with a laser beam to form an electrostatic latent image thereon, and a cleaning device 6 that cleans the surface of the photosensitive drum 2.

Developing devices 18*a* to 18*d* are respectively provided for the four colors of toners (i.e., yellow, magenta, cyan, and black). The developing devices 18*a* to 18*d* are configured to supply the toners to the electrostatic latent image formed on the surface of the photosensitive drum 2 so as to develop the image.

The developing devices 18*a* to 18*d* are integrally supported by a substantially circular rotary (developing-device support member) 102 that is rotatable in the forward direction with respect to the rotating direction of the photosensitive drum 2. The rotary 102 can be rotated by a driving mechanism to be described later such that each of the developing devices 18*a* to 18*d* can be brought to a development position facing the photosensitive drum 2.

The developing devices 18*a* to 18*d* may be configured to be detachable from the rotary 102. This configuration allows for refilling of the toner and maintenance for each developing device, thereby enhancing the convenience for users.

Reference numeral 300 in FIG. 1 denotes a drive transmission member provided in a main apparatus body. The drive transmission member 300 engages with a coupling member 200 (to be described later) provided in each developing device 18 so as to rotationally drive a developing roller (toner bearing member) 182 included in the developing device 18. The engagement between the drive transmission member 300 and the coupling member 200 will be described later. The term "main apparatus body" in this case refers to the body of the image forming apparatus excluding the developing devices 18.

When forming an image on a sheet S, the photosensitive drum 2 is rotated in the direction of an arrow in FIG. 1 (counterclockwise) in synchronization with the rotation of an intermediate transfer belt 7.

Then, the charge roller 3 uniformly charges the surface of this photosensitive drum 2, and the exposure unit 4 performs light irradiation (exposure) of, for example, a yellow image so as to form an electrostatic latent image corresponding to the yellow image on the surface of the photosensitive drum 2.

Prior to the formation the electrostatic latent image, the rotary 102 is driven by a drive transmission mechanism to be described later so as to rotationally move the developing device 18*a*, corresponding to the yellow color, to a position (development position) facing the photosensitive drum 2.

At this development position, a voltage with the same polarity as the toner is applied to a rotatable developing roller (toner bearing member) 182*a* included in the developing device 18*a* so that the yellow toner is adhered to the electrostatic latent image on the photosensitive drum 2, whereby the electrostatic latent image can be developed as a toner image.

After the development process, the developing roller 182*a* is moved away from the surface of the photosensitive drum 2. Then, a voltage with a polarity opposite to that of the toner is applied to a primary transfer roller 8 disposed on the inner side of the intermediate transfer belt 7 so that the toner image formed on the surface of the photosensitive drum 2 is primarily transferred onto the intermediate transfer belt 7.

When the primary transfer process of the yellow toner image is completed in this manner, the rotary 102 is rotated again so that the developing devices 18 are sequentially switched from the yellow developing device 18*a* to the developing devices 18*b* to 18*d* respectively corresponding to the magenta, cyan, and black colors.

After the developing devices 18 are each positioned at the development position facing the photosensitive drum 2, the development and primary transfer processes are performed sequentially for the magenta, cyan, and black colors in the same manner as for the yellow color. As a result, the toner images of the four colors are superposed and transferred on the intermediate transfer belt 7.

While the toner images of the respective colors are being primarily transferred onto the intermediate transfer belt 7, a secondary transfer roller 82 is kept out of contact with the intermediate transfer belt 7. At the same time, a cleaning unit 9 that cleans the intermediate transfer belt 7 is also kept out of contact with the intermediate transfer belt 7.

On the other hand, the sheets S are stacked and stored in a feeder cassette 51 provided at a lower section of the main apparatus body and are separated and fed one by one by a feeding roller 52 from the feeder cassette 51 towards a pair of registration rollers 53.

The registration rollers 53 send the fed sheet S to a nip portion formed between the intermediate transfer belt 7 and the secondary transfer roller 82. At the nip portion, the secondary transfer roller 82 and the intermediate transfer belt 7 are in pressure contact with each other (i.e., the state shown in FIG. 1).

When the toner images are to be secondarily transferred onto the sheet S, the sheet S is first conveyed to the nip portion, and a voltage with a polarity opposite to that of the toners is applied to the secondary transfer roller 82 so that the toner images on the intermediate transfer belt 7 can collectively be secondarily transferred onto the surface of the sheet S.

The sheet S with the toner images secondarily transferred thereon is subsequently sent to a fixing unit 54. The sheet S is heated and pressed at the fixing unit 54 so that the toner images can be fixed onto the sheet S. Subsequently, the sheet S is ejected from the fixing unit 54 to an eject unit provided in an upper cover 55 outside the main apparatus body.

Configuration of Developing Devices

Figure 2:
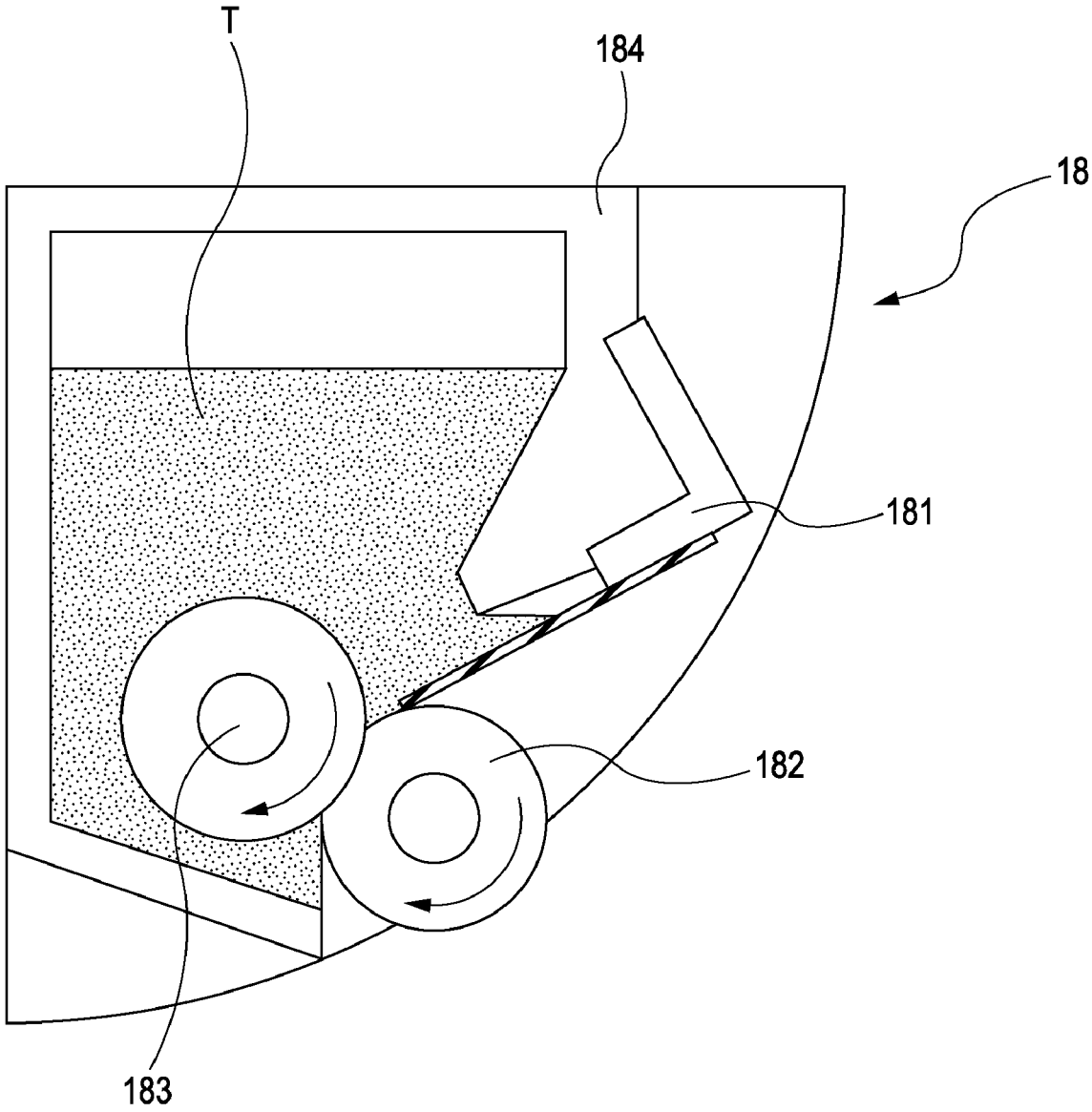
FIG. 2 schematically illustrates a developing device according to the first embodiment.

The configuration of the developing devices 18*a* to 18*d* according to the first embodiment will now be described with reference to FIG. 2. Since the developing devices 18*a* to 18*d* according to the first embodiment all have the same configuration, the description below will be directed to only one of the developing devices 18*a* to 18*d*.

In the first embodiment, the developing device 18 employs a contact development method. A contact-development-type developing device 18 includes a developing roller 182 serving as a toner bearing member, a regulation blade 181, a toner supplying roller 183, and a toner accommodating chamber 184.

The developing roller 182 is rotatable. While the developing roller 182 carries a toner on the surface thereof and rotates, the developing roller 182 comes into contact with the surface of the photosensitive drum 2 so as to supply the toner to the electrostatic latent image preliminarily formed on the surface of the photosensitive drum 2.

In the first embodiment, the developing roller 182 rotates in the forward direction with respect to the rotating direction of the photosensitive drum 2, and the peripheral speed of the developing roller 182 is set at 160% of the peripheral speed of the photosensitive drum 2.

The developing roller 182 used in the first embodiment is formed by bonding a silicon rubber layer serving as a base layer around the outer periphery of an SUS core metal and coating the surface layer with urethane resin.

The regulation blade 181 is formed of a thin plate of an SUS material (with a thickness of 80 μm). The regulation blade 181 is disposed so as to be oriented in a counter direction relative to the rotating direction of the developing roller 182. By disposing the regulation blade 181 in this manner, the amount of toner covering the developing roller 182 can be regulated as the developing roller 182 rotates.

The toner supplying roller 183 is formed by wrapping urethane sponge around the outer periphery of a core metal. The toner temporarily contained in the toner supplying roller 183 is supplied to the surface of the developing roller 182 at a contact portion between the toner supplying roller 183 and the developing roller 182.

The developing roller 182 and the toner supplying roller 183 rotate in the same direction. In other words, the surfaces of the two rollers at the contact portion therebetween move in the opposite direction.

When the developing device 18 is disposed at the development position as a result of an operation to be described later, a predetermined voltage is applied to each of the components in the developing device 18.

For example, when the development process is to be performed in the first embodiment, the electric potential of the photosensitive drum 2 is such that a voltage of −500 V is applied to an unexposed section thereof and a voltage of −150 V is applied to an exposed section thereof, and a voltage of about −350 V is applied to the developing roller 182, the regulation blade 181, and the toner supplying roller 183.

With such electric-potential setting, a negative-polarity toner does not adhere to the unexposed section but adheres to the exposed section due to an electrostatic force. Although the developing roller 182, the toner supplying roller 183, and the regulation blade 181 are given the same electric potential in the first embodiment, the electric potential may alternatively vary among the components.

Configuration of Developing-Device Support Member

The configuration of the rotary (developing-device support member) 102 and the peripheral components thereof according to the first embodiment will now be described with reference to FIGS. 3 and 4. The rotary 102 supports the plurality of developing devices 18.

Figure 3:
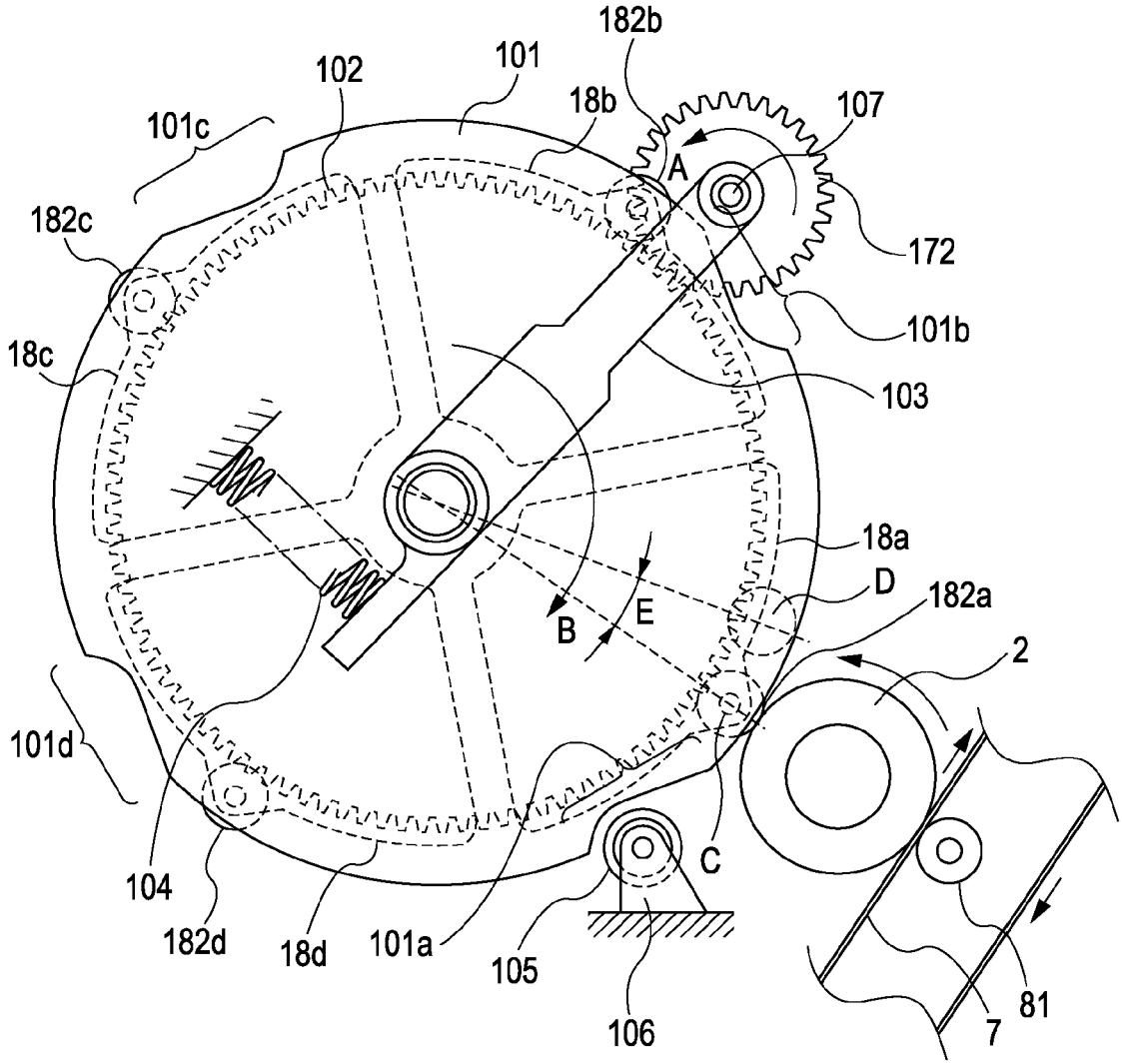
FIG. 3 schematically illustrates a rotary and peripheral components thereof according to the first embodiment.

FIG. 3 illustrates a state (i.e., contact state) where the developing roller 182*a* rotatably supported by the developing device 18*a* is developing the electrostatic latent image formed on the surface of the photosensitive drum 2. FIG. 4 illustrates a state where the developing device 18*a* is being switched to the developing device 18*b* by the rotation of the rotary 102.

The substantially circular rotary 102, which is rotatable, has gear teeth formed on the outer periphery thereof, and the gear teeth are meshed with a drive gear 172. Specifically, a driving force from a driving source (not shown) is transmitted to the drive gear 172 so as to cause the rotary 102 to rotate. When the drive gear 172 rotates in a direction indicated by an arrow A in FIG. 3, the rotary 102 rotates in a direction indicated by an arrow B in FIG. 3, whereas when the drive gear 172 stops, the rotary 102 also stops accordingly.

The drive gear 172 is supported by the main apparatus body by means of a shaft 107. When the driving source (not shown) stops, the drive gear 172 also stops, whereas the drive gear 172 is incapable of driving the driving source.

The shaft 107 for the drive gear 172 and the center of rotation of the rotary 102 are linked to each other by means of an arm 103. The arm 103 is rotatably supported by the shaft 107. The arm 103 is biased by an arm spring 104 whose one end is fixed to the main apparatus body, such that the arm 103 receives a rotational force about the shaft 107.

The rotary 102 integrally supports the developing devices 18*a* to 18*d* such that developing rollers 182*a* to 182*d* included in the developing devices 18*a* to 18*d* are set substantially on the circumference (i.e., substantially on the outer periphery) of the rotary 102. Moreover, the rotary 102 is rotatably supported by the arm 103.

A cam 101 that is rotatable in a concentric manner with the rotary 102 is provided in front of the rotary 102, as viewed from the viewer's side of FIG. 3. The cam 101 has recesses 101*a* to 101*d* having the same shape and disposed substantially at equal intervals on the outer periphery thereof, and is engaged with the rotary 102 at the center of rotation.

In other words, the cam 101 and the rotary 102 are configured to constantly move in synchronization with each other. Although the rotary 102 and the cam 101 are provided as separate components in the first embodiment, the two components may be provided as a single unit.

A regulation roller 105 is provided in the vicinity of the cam 101 and in contact with the outer periphery of the cam 101. While being in contact with the outer periphery of the cam 101, the regulation roller 105 is rotatably supported by a roller holder 106 set in the main apparatus body.

Because the surface layer of the regulation roller 105 is a rubber layer having elasticity, noise produced when the regulation roller 105 and the outer periphery of the cam 101 are in contact with each other can be reduced, and the cam 101 can be properly rotated due to the high friction coefficient of the rubber layer.

Although the regulation roller 105 is rotatably supported by the roller holder 106 in the first embodiment, the regulation roller 105 does not necessarily need to be rotatable if the outer peripheral surface of the regulation roller 105 has good slidability, and moreover, does not necessarily need to be a roller. In other words, the regulation roller 105 may be any kind of component so long as it is capable of coming into contact with the outer periphery of the cam 101 and properly guiding the rotation of the cam 101 without interfering with the rotation.

In FIG. 3, the regulation roller 105 is disposed in the vicinity of the recess 101*a* (or one of 101*b* to 101*d*) provided in the cam 101, and the recesses 101*a* to 101*d* are disposed on the outer periphery of the cam 101 to prevent the regulation roller 105 and the cam 101 from coming into contact with each other.

The arm 103 biased by the arm spring 104 first biases the rotary 102, and this biasing force ultimately becomes a contact pressure between the developing roller 182*a* (or one of 182*b* to 182*d*) and the photosensitive drum 2.

Figure 4:
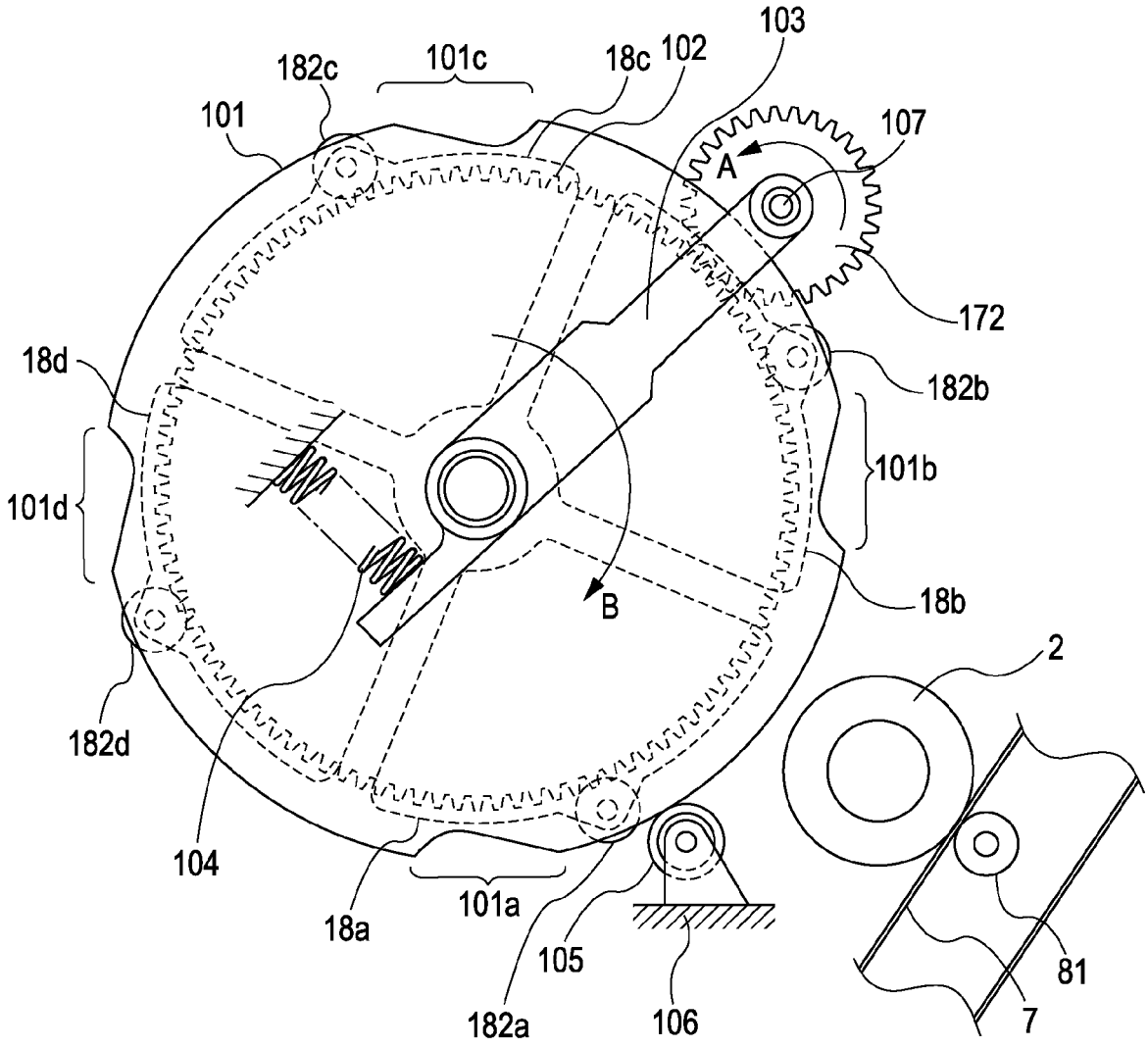
FIG. 4 schematically illustrates the rotary and the peripheral components thereof according to the first embodiment.

As mentioned above, in FIG. 3, the biasing force of the arm spring 104 causes the developing roller 182*a* to come into contact with the surface of the photosensitive drum 2 with a suitable contact pressure, but when the rotary 102 rotates, the contact state between the developing roller 182*a* and the photosensitive drum 2 is released (i.e., the state shown in FIG. 4).

Specifically, while the development process is being performed, the rotary 102 is stopped, but when the development process is completed, the rotary 102 rotates again so as to cause the developing roller 182*a* to move out of contact with the surface of the photosensitive drum 2.

When the developing roller 182*a* moves out of contact with the surface of the photosensitive drum 2, the cam 101 comes into contact with the regulation roller 105.

The outer periphery of the cam 101 excluding the recesses 101*a* to 101*d* is formed such that, when the outer periphery comes into contact with the regulation roller 105, the developing devices 18*a* to 18*d* are prevented from coming into contact with the photosensitive drum 2. Therefore, the developing devices 18*a* to 18*d* can be sequentially moved to the development position without affecting the photosensitive drum 2. Thus, the developing rollers 182*a* to 182*d* can be sequentially brought into contact with the surface of the photosensitive drum 2.

In detail, when the developing device 18*b* (or one of 18*c* and 18*d*) is to be moved to the development position, a controller (not shown) cuts off the driving force to the drive gear 172, and the recess 101*b* (or one of 101*c* and 101*d*) of the cam 101 comes to the vicinity of the regulation roller 105. Consequently, the developing roller 182*b* (or one of 182*c* and 182*d*) and the photosensitive drum 2 can be brought into contact with each other with a predetermined pressure. In this manner, the developing devices 18*a* to 18*d* sequentially develop the electrostatic latent image.

According to the first embodiment, the developing rollers 182*a* to 182*d* can be sequentially moved into and out of contact with the surface of the photosensitive drum 2 by simply rotating the rotary 102.

In other words, in the first embodiment, the operation for moving the developing rollers 182*a* to 182*d* into and out of contact with the surface of the photosensitive drum 2 can be performed from the tangential direction of the photosensitive drum 2, and significantly differs from the related art in which such operation for moving the developing rollers into and out of contact with the surface of the photosensitive drum is performed from the radial direction of the photosensitive drum.

Accordingly, since a configuration for, for example, entirely moving the rotary 102 in the radial direction of the photosensitive drum 2 is not required, it is not necessary to provide an additional space for moving the developing rollers 182*a* to 182*d* into and out of contact with the photosensitive drum 2. Therefore, the main apparatus body can be reduced in size.

Furthermore, since the operation for moving the developing rollers 182*a* to 182*d* into and out of contact with the photosensitive drum 2 can be performed by simply rotating the rotary 102 for switching between the developing devices 18*a* to 18*d*, it is not necessary to provide a designated configuration or a driving source specifically for moving the developing rollers 182*a* to 182*d* into and out of contact with the photosensitive drum 2. Therefore, the manufacturing cost can be reduced.

Furthermore, since the operation for moving the developing rollers 182*a* to 182*d* into and out of contact with the photosensitive drum 2 and the operation for switching between the developing devices 18*a* to 18*d* can be performed simultaneously, the developing rollers 182*a* to 182*d* can be sequentially brought into and out of contact with the photosensitive drum 2 at high speed.

In the first embodiment, a pulse motor is used as the driving source (not shown) for the rotary 102 so that the rotational driving of the rotary 102 can be freely controlled.

Method of Transmitting Driving Force to Toner Bearing Member

A method of transmitting a driving force to each of the developing rollers 182*a* to 182*d* according to the first embodiment will now be described with reference to FIGS. 5 to 9. FIGS. 5 to 8B schematically illustrate the configuration of a coupling section of one of the developing devices 18 according to the first embodiment. FIG. 9 illustrates the timing for controlling the rotation of the rotary 102.

In the first embodiment, a rotational driving force is transmitted to the developing roller 182 via a path constituted by a driving source (not shown), the drive transmission member 300 (in the main apparatus body), the coupling member 200 (in the developing device 18), gears 185 and 186, and the developing roller 182 (and the toner supplying roller). Each of these components will be described below.

Gears

Figure 5:
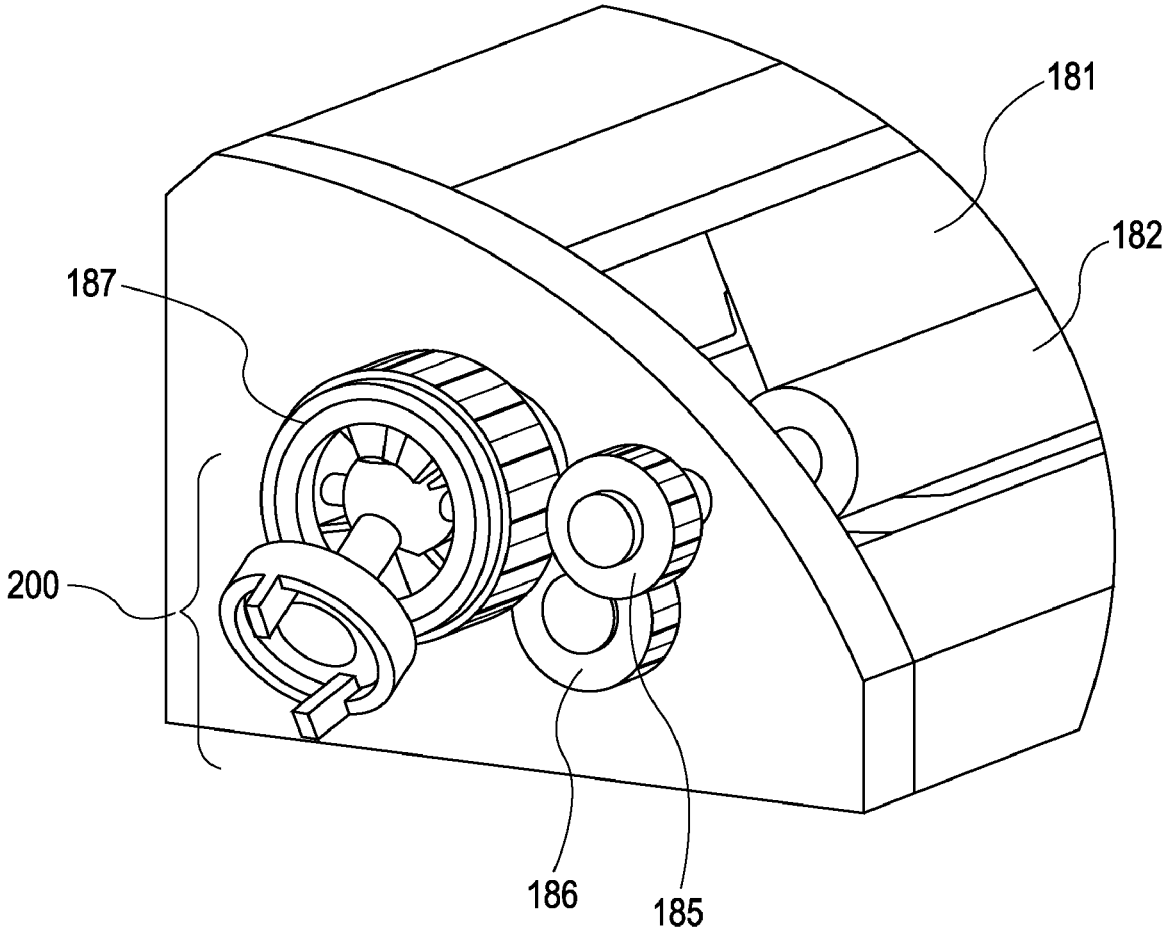
FIG. 5 schematically illustrates a coupling member of the developing device according to the first embodiment.

FIG. 5 illustrates a side surface of the developing roller 182 in the developing device 18, as viewed in the axial direction thereof. As shown in FIG. 5, an end of the core metal of the developing roller 182 and an end of the core metal of the toner supplying roller 183 (not shown in FIG. 5) are respectively provided with the gears 185 and 186. These gears 185 and 186 are disposed so as to be meshed with each other. The gear 185 is engaged with a drive transmission gear 187 to which a rotational driving force is transmitted from a driving source to be described later.

These gears 185 and 186 receive the rotational driving force from the drive transmission member 300 provided in the main apparatus body via the coupling member 200 and the drive transmission gear 187 disposed in the developing device 18.

Drive Transmission Gear

The drive transmission member 300 in the main apparatus body that engages with the coupling member 200 provided in the developing device 18 will now be described with reference to FIGS. 6A to 6C.

Figure 6A:
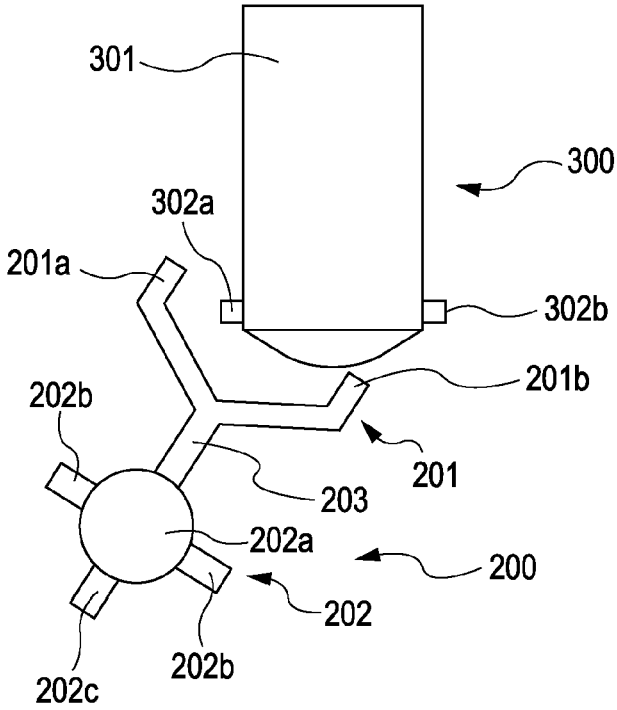
FIGS. 6A to 6C schematically illustrate the coupling member of the developing device according to the first embodiment.
Figure 6B:
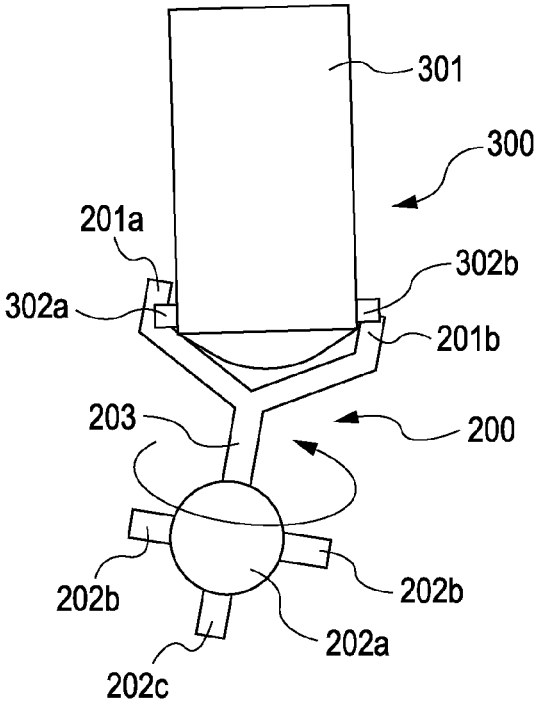
Figure 6C:
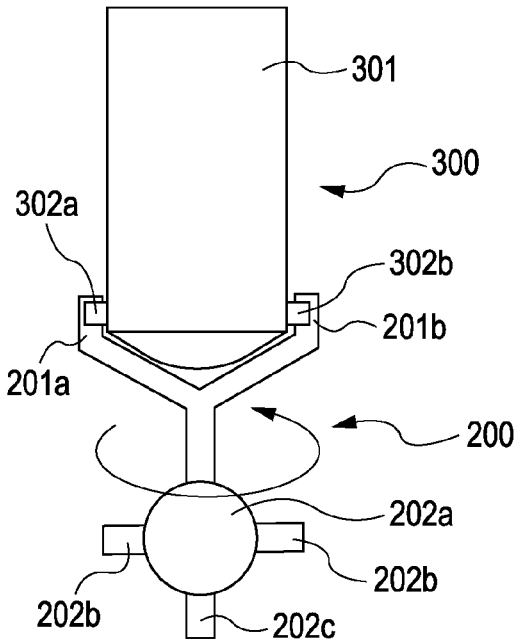

FIGS. 6A to 6C illustrate the engagement between the coupling member 200 provided in the developing device 18 and the drive transmission member 300 provided in the main apparatus body.

FIG. 6A illustrates a state where the coupling member 200 in the developing device 18 and the drive transmission member 300 in the main apparatus body are not engaged with each other. FIG. 6B illustrates a state where the coupling member 200 and the drive transmission member 300 are engaged with each other before the developing device 18 reaches the development position. FIG. 6C illustrates a state where the coupling member 200 and the drive transmission member 300 are engaged with each other when the developing device 18 is at the development position.

As shown in FIG. 6A, the drive transmission member 300 according to the first embodiment includes a drive shaft 301 and pins (protrusions) 302*a* and 302*b* fitted in the outer periphery of the drive shaft 301 in a direction orthogonal to the drive shaft 301.

By engaging the pins 302*a* and 302*b* with the coupling member 200, a rotational driving force can be transmitted from the drive transmission member 300 to the coupling member 200. In other words, the pins 302*a* and 302*b* serve as a rotational-force applying unit in the drive transmission member 300.

On the other hand, the drive shaft 301 is configured to receive a rotational force from the driving source (not shown). In the first embodiment, when the image forming operation commences, the drive shaft 301 receives a rotational force from the driving source (not shown) and continues to rotate, regardless of whether the developing device 18 is or is not at the development position.

Coupling Member

The coupling member 200 provided in each developing device 18 mainly has three portions. The first portion is a driven portion 201. As shown in FIG. 6C, the driven portion 201 is engageable with the pins 302*a* and 302*b* of the drive shaft 301 in the main apparatus body.

The driven portion 201 is provided with two claws 201*a* and 201*b* that engage with the two pins 302*a* and 302*b* provided as a rotational-force applying unit on the drive shaft 301 so as to receive a rotational driving force from the pins 302*a* and 302*b*.

The second portion is a driving portion 202. The driving portion 202 is constituted by a spherical part 202*a*, pins 202*b* that fit in the developing device 18 to transmit a rotational force, and a tilt-angle regulation member 202*c* that regulates the tilt angle of the coupling member 200.

According to this configuration, the pins 202*b* engage with the drive transmission gear 187 (i.e., a rotational-force receiving portion and a rotational-force transmitted portion in FIG. 5) provided in the developing device 18 so as to transmit a rotational driving force to the gears 185 and 186.

The tilt-angle regulation member 202*c* is configured to be fitted in a regulation groove provided in the developing device 18. When the tilt-angle regulation member 202*c* is fitted in the regulation groove, the orientation of the coupling member 200 can be regulated along the regulation groove.

The third portion is an intermediate portion 203 that connects the driven portion 201 and the driving portion 202. In the first embodiment, before engaging the coupling member 200 and the drive transmission member 300 with each other, the coupling member 200 is preliminarily tilted to a pre-engaged angular position (i.e., the position shown in FIG. 6A).

Figure 7:
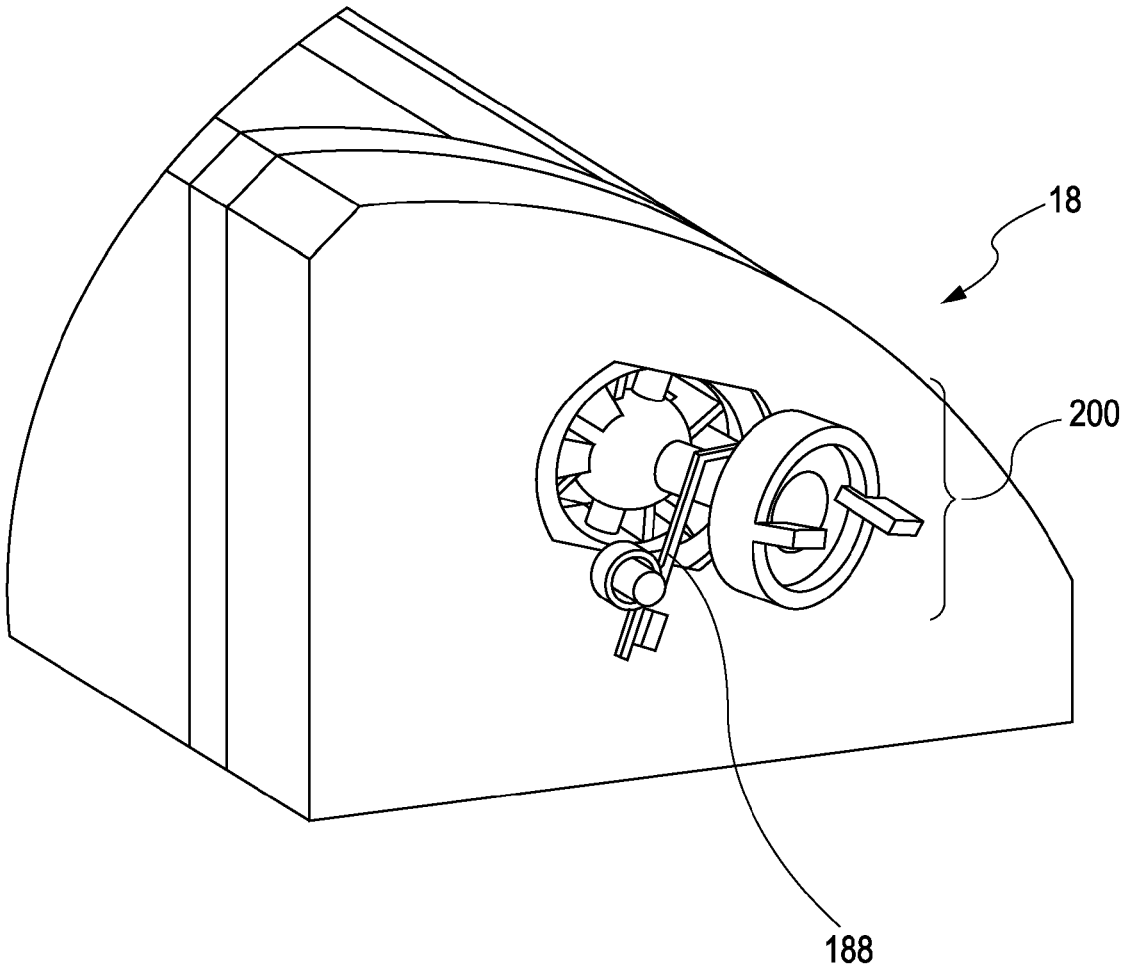
FIG. 7 schematically illustrates the coupling member of the developing device according to the first embodiment.

In detail, the coupling member 200 is configured to be tilted by hooking a bias spring 188 onto the intermediate portion 203, as shown in FIG. 7.

The direction in which the coupling member 200 is preliminarily tilted is a direction in which the end of the coupling member 200 (i.e., the end closer to the driven portion 201) moves to receive the drive shaft 301 when the rotary 102 is rotated (namely, the state shown in FIG. 6A).

By preliminarily tilting the coupling member 200 towards the drive shaft 301 in the main apparatus body, the drive transmission member 300 in the main apparatus body and the coupling member 200 in the developing device 18 can be brought into engagement with each other before the developing device 18 reaches the development position.

In the first embodiment, when the development position is defined as an angle 0°, the coupling member 200 and the drive transmission member 300 are engageable with each other at a position preceding the development position by a rotational angle of 7° of the rotary 102 (FIG. 6B). The rotational angle of the rotary 102 is defined as 0° at the position where the developing roller 182 and the photosensitive drum 2 are brought into contact with each other in FIG. 3 (i.e., position C). When the developing roller 182 is at position D, the rotational angle of the rotary 102 is expressed as E°. When the developing device 18 is at the development position, the center of the drive shaft 301 and the center of the coupling member 200 are substantially on the same line (FIG. 6C).

On the other hand, in the aforementioned drive transmission method, even when the drive shaft 301 and the coupling member 200 are disposed at an engageable position, the process for engaging the pins 302*a* and 302*b* of the drive shaft 301 with the claws 201*a* and 201*b* of the coupling member 200 may require some time.

This is due to the phase relationship between the pins 302*a* and 302*b* in the drive shaft 301 and the claws 201*a* and 201*b* in the coupling member 200 (simply referred to as "phase relationship between the two" hereinafter).

Figure 8A:
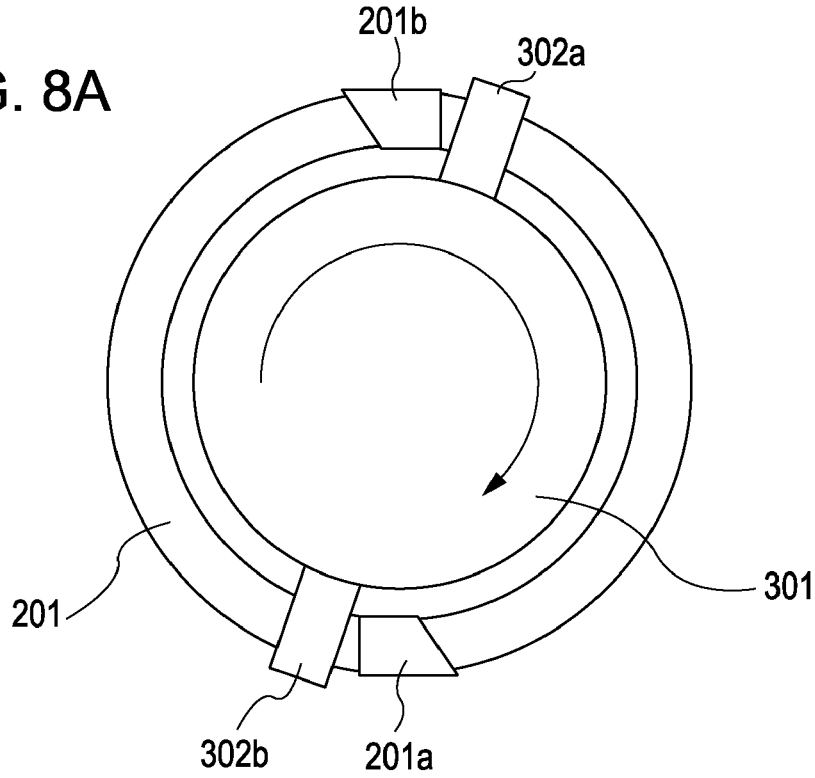
FIGS. 8A and 8B illustrate the phase relationship between the coupling member of the developing device and a drive transmission member of a main apparatus body according to the first embodiment.
Figure 8B:
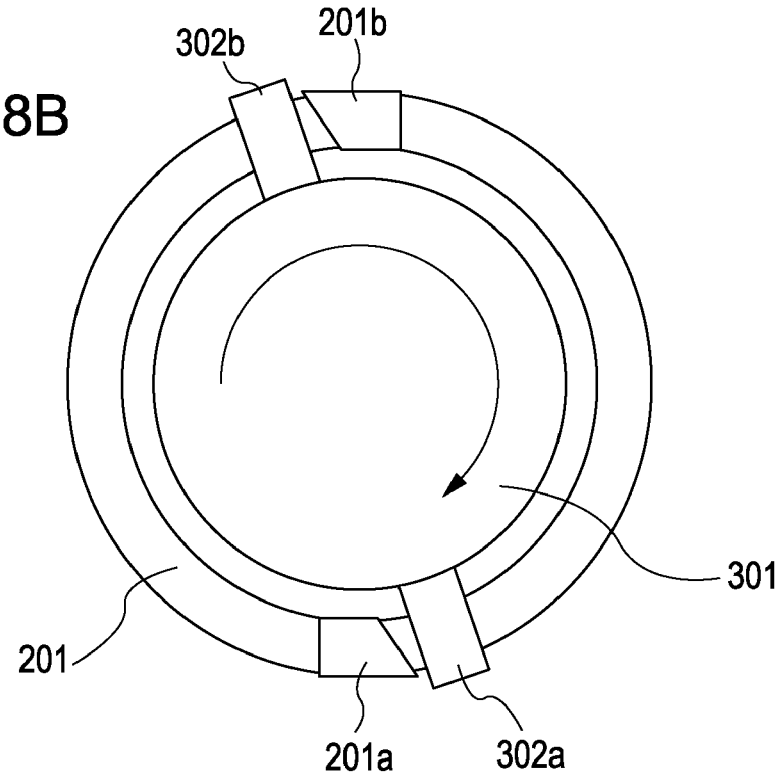
Figure 9:
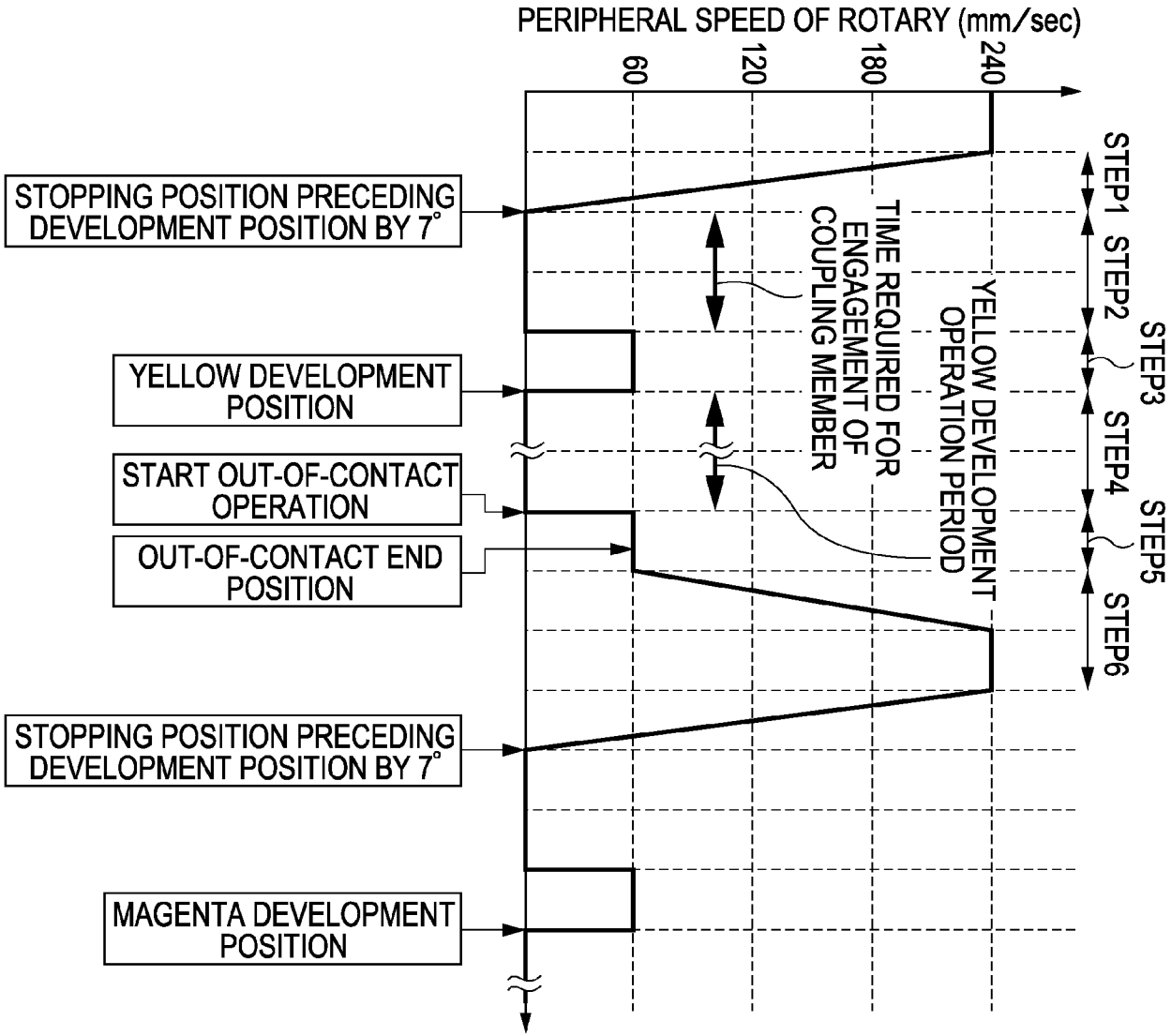
FIG. 9 illustrates the timing for controlling the rotation of the rotary according to the first embodiment.

Specifically, when the phase relationship between the two is as shown in FIG. 8A, it is necessary to rotate the pins 302*a* and 302*b* by about 180° in order to engage the pins 302*a* and 302*b* with the claws 201*a* and 201*b*. Therefore, in this case, the time required for bringing the pins 302*a* and 302*b* into engagement with the claws 201*a* and 201*b* is at maximum.

In a rotary-type image forming apparatus, the number of output sheets can be increased by minimizing the time required for switching between the developing devices 18. Therefore, it is desirable that the rotating speed of the rotary 102 be increased as much as possible.

However, increasing the rotating speed of the rotary 102 results in a shorter time for the coupling member 200 to move from the engageable position with the drive transmission member 300 in the main apparatus body (i.e., the position preceding the development position by 7° in the first embodiment) to the development position.

In other words, since the time that takes the coupling member 200 and the drive transmission member 300 to engage with each other is shortened, the developing device 18 reaches the development position before the coupling member 200 comes into engagement with the drive transmission member 300, causing the developing roller 182, which is not rotating yet, to come into contact with the surface of the photosensitive drum 2.

When the developing roller 182, not rotating yet, comes into contact with the surface of the photosensitive drum 2 in this manner, the toner carried by the surface of the developing roller 182 is scraped off by a friction force produced by the rotation of the photosensitive drum 2, creating a fog on the surface of the photosensitive drum 2.

When a fog forms on the surface of the photosensitive drum 2, the fog stains the intermediate transfer belt 7 and gets transferred onto the secondary transfer roller 82, resulting in staining on the back face of the sheet S (i.e., an image defect).

When the developing roller 182, without rotating, repeatedly comes into contact with the photosensitive drum 2, the toner becomes rubbed against the surface of the photosensitive drum 2, possibly causing a phenomenon in which the toner becomes fused with the surface of the photosensitive drum 2.

Therefore, regardless of the phase relationship between the coupling member 200 and the drive transmission member 300, the developing roller 182 needs to be properly rotated before bringing the developing roller 182 into contact with the surface of the photosensitive drum 2.

In the first embodiment, the rotation of the rotary 102 is temporarily stopped before the developing device 18 reaches the development position as well as at the position where the coupling member 200 and the drive transmission member 300 are engageable with each other so as to ensure the required time for the engagement. Subsequently, the rotary 102 is rotated again so as to move the developing device 18 to the development position.

The stopping time period of the rotary 102 in this case is set at least longer than or equal to a time period required for the engagement between the coupling member 200 and the drive transmission member 300. Specifically, this time period is equal to the time that takes the claws 201*a* and 201*b* of the driven portion 201 and the pins 302*a* and 302*b* of the drive shaft 301 to reach the engagement position (FIG. 8B) from a position with a phase opposite (FIG. 8A) to that of the engagement position. A method for calculating this time period will be described below.

In the first embodiment, the number of revolutions F of the drive transmission member 300 is set at 130 rpm, and a maximum phase shift angle R from the coupling-engagement position is set to 180° since the drive shaft 301 has two pins 302*a* and 302*b* and the coupling member 200 has two claws 201*a* and 201*b*. According to the following equations (1) and (2), a temporary stopping time period S of the rotary 102 can be calculated to be 230 msec.

If the maximum value of either the number of claws of the coupling member 200 or the number of pins of the drive shaft 301 is defined as P, the maximum phase shift angle R between the claws and the pins can be calculated as follows:

$$R=360/P \quad (1)$$

Using the maximum phase shift angle R and the number of revolutions F of the drive transmission member 300, the stopping time period S of the rotary 102 can be calculated as follows:

$$S=(60/F)\times(R/360) \quad (2)$$

Timing for Controlling the Rotation of Rotary

The timing for controlling the rotation of the rotary 102 will now be described with reference to FIG. 9. FIG. 9 shows the timing for controlling the rotation of the rotary 102 based on the time period calculated from on the above equations.

In STEP 1, the speed of the rotary 102 is reduced before the developing device 18 reaches the development position, and the rotary 102 is temporarily stopped at the position preceding the development position by about 7° (the developing roller 182 and the photosensitive drum 2 are not in contact with each other).

STEP 2 is a standby period for a predetermined time in which the coupling member 200 and the drive transmission member 300 are properly engaged with each other. In STEP 3, the rotary 102 is rotationally driven at low speed so as to move the developing device 18 to the development position.

In STEP 4, the development process is performed at the development position. Upon completion of the development process, the rotary 102 is driven again at low speed in STEP 5 so as to move the developing roller 182 out of contact with the surface of the photosensitive drum 2.

After moving the developing roller 182 out of contact with the surface of the photosensitive drum 2, the rotating speed of the rotary 102 is increased in STEP 6 so as to move the developing roller 182 of the subsequent developing device 18 to the engageable position within a short time period.

By repeating these steps, a full color image is formed on the sheet S. According to the first embodiment, the developing roller 182 is brought into contact with the photosensitive drum 2 after the developing roller 182 is properly rotated, thereby allowing for an image forming operation with minimal image defects, such as a fog or fusion. The rotation of the rotary 102 is controlled by a control unit 400, such as a CPU, provided in the main apparatus body.

When the developing roller 182 is to be moved into or out of contact with the photosensitive drum 2, the speed of the rotary 102 is reduced as much as possible so that an impact and rubbing between the developing roller 182 and the photosensitive drum 2 can be reduced.

Accordingly, rubbed marks between the developing roller 182 and the regulation blade 181 can also be effectively minimized. In addition, irradiation deviation occurring in the exposure unit 4 due to an impact produced when the developing roller 182 is brought into contact with the surface of the photosensitive drum 2 can also be effectively minimized.

By gently moving the developing roller 182 out of contact with the surface of the photosensitive drum 2, fluctuations in the peripheral speed of the photosensitive drum 2 can be reduced, thereby effectively minimizing transfer defects (transfer deviation) in the primary transfer process.

In the first embodiment, the peripheral speed of the photosensitive drum 2 is set at 100 mm/sec, whereas the peripheral speed of the rotary 102 when the developing roller 182 is moved into or out of contact with the photosensitive drum 2 is set at 60 mm/sec and the maximum peripheral speed of the rotary 102, when moving, is set at 240 mm/sec.

Accordingly, the first embodiment provides a rotary-type image forming apparatus that allows for good image quality as well as a smaller main apparatus body and lower costs.

Second Embodiment

An image forming apparatus according to a second embodiment of the present invention will now be described with reference to FIG. 10. Since the configuration of the image forming apparatus according to the second embodiment and the configuration of the developing devices are substantially the same as those of the image forming apparatus according to the first embodiment, the descriptions thereof will not be repeated. The following description will only be directed to the differences from the first embodiment.

The second embodiment has a characteristic feature in the control of the rotational driving of the rotary 102. In the first embodiment, the temporary stopping time period of the rotary 102 before the developing device 18 reaches the development position is a time period in which the pins 302*a* and 302*b* and the claws 201*a* and 201*b* can properly engage with each other.

Figure 10:
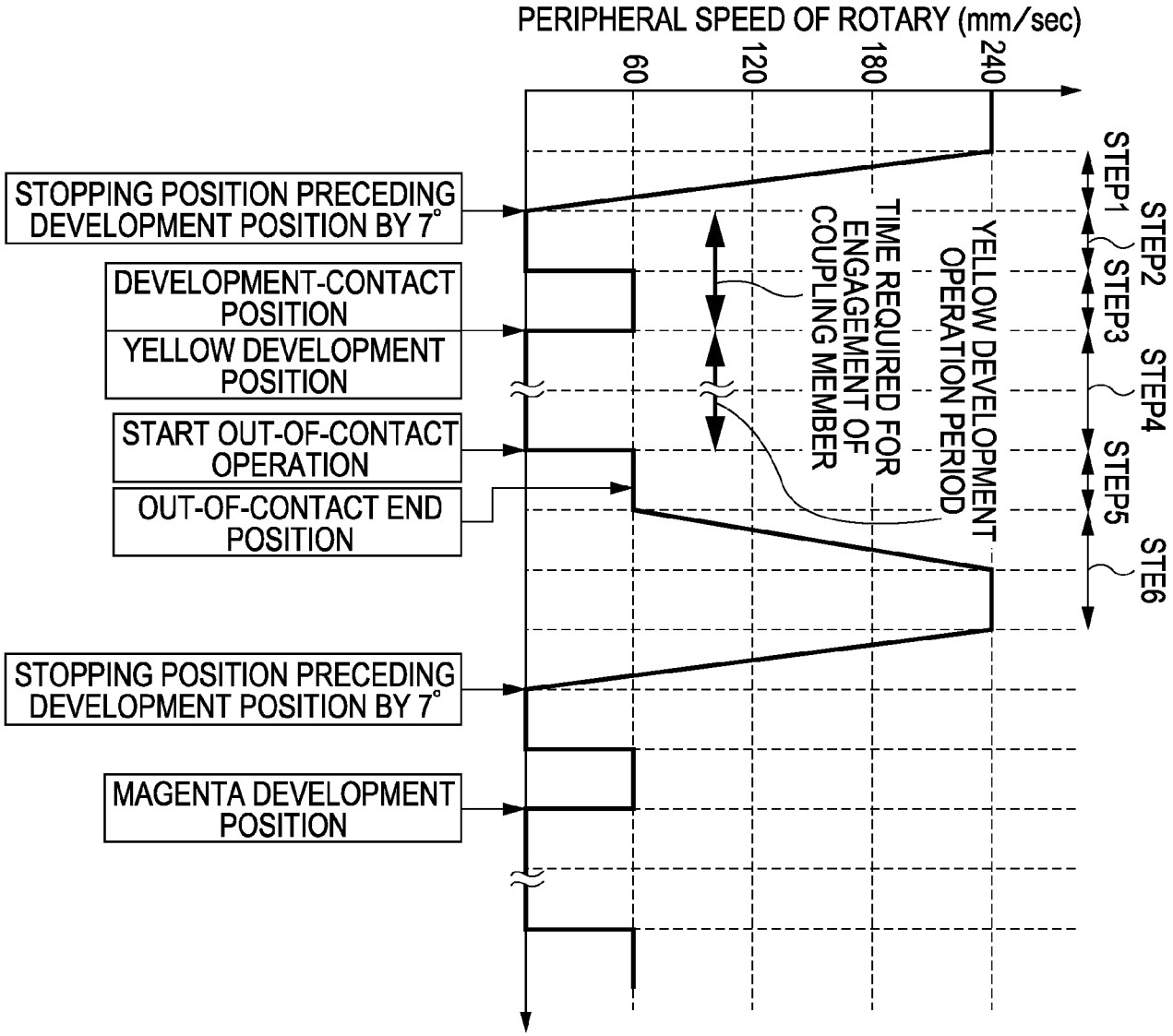
FIG. 10 illustrates the timing for controlling the rotation of the rotary according to a second embodiment.

In contrast, in the second embodiment, the rotational driving of the rotary 102 is controlled such that the pins 302*a* and 302*b* and the claws 201*a* and 201*b* can engage with each other within a time period equal to the sum of the temporary stopping time period of the rotary 102 and a time period extending from a pre-development stopping position to the contact position, as shown in STEP 2 to STEP 3 in FIG. 10. Similar to the first embodiment, this rotational-driving control can be performed by the control unit 400, such as a CPU, provided in the main apparatus body.

In other words, in the engagement process between the coupling member 200 and the drive transmission member 300, the rotation of the rotary 102 is resumed in the latter half of the process, which is when the engagement is mostly completed.

In the second embodiment, the coupling member 200 according to the first embodiment is used so that the coupling member 200 can be brought into engagement with the already-rotating drive transmission member 300 in the main apparatus body.

In the second embodiment, the time period required for the engagement is set to 230 msec, like the first embodiment, and the time period for moving from the position preceding the development position by 7° to the development position (i.e., the contact position) is set to about 110 msec. Based on these set conditions, the standby time at the position preceding the development position by 7° is set to 120 msec.

By performing such control, the same advantages as the first embodiment can be achieved, and the time period for switching between the developing devices can be made even shorter than the first embodiment. In other words, an image forming apparatus that can form images at higher speed can be provided.

Third Embodiment

An image forming apparatus according to a third embodiment of the present invention will now be described with reference to FIG. 11. Since the configuration of the image forming apparatus according to the third embodiment and the configuration of the developing devices are substantially the same as those of the image forming apparatus according to the first embodiment, the descriptions thereof will not be repeated. The following description will only be directed to the differences from the first embodiment.

The third embodiment has a characteristic feature in the control of the rotational driving of the rotary 102. In the first embodiment, the temporary stopping time period of the rotary 102 before the developing device 18 reaches the development position is a time period in which the pins 302*a* and 302*b* and the claws 201*a* and 201*b* can properly engage with each other (see STEP 2 in FIG. 9).

In contrast, in the third embodiment, instead of completely stopping the rotary 102, the rotating speed of the rotary 102 is reduced at the engageable position of the pins 302*a* and 302*b* and the claws 201*a* and 201*b*. In the third embodiment, the rotating speed of the rotary 102 is reduced during STEP 2 to STEP 3 in the first embodiment.

Figure 11:
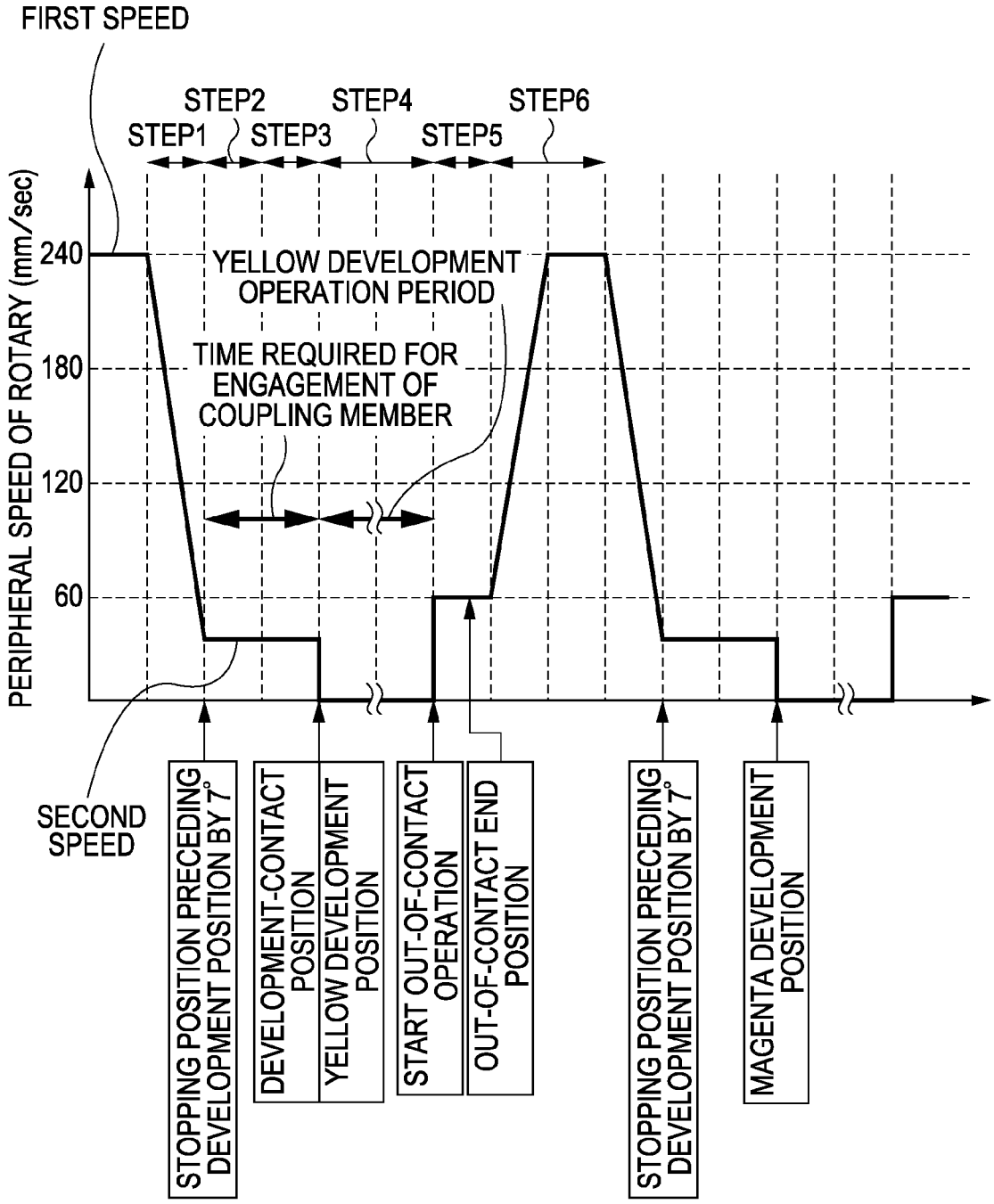
FIG. 11 illustrates the timing for controlling the rotation of the rotary according to a third embodiment.

As shown in FIG. 11, the control unit 400 (CPU) adjustably controls the rotating speed of the rotary 102 between a speed (first speed) before arrival at the engageable position and a speed (second speed) after arrival at the engageable position. The second speed is lower than the first speed. As shown in STEP 2 to STEP 3 in FIG. 11, the rotational driving of the rotary 102 is controlled such that the coupling member 200 becomes engageable prior to the contact of the developing roller 182 with the photosensitive drum 2 by utilizing the time period in which the rotary 102 rotates at the second speed. On the other hand, the rotary 102 is rotationally driven at a speed higher than the second speed for times other than the time just before the developing device 18 reaches the development-contact position.

The time period in which the rotary 102 rotates at the second speed is not particularly limited so long as the coupling member 200 becomes engageable before the developing device 18 reaches the development-contact position. However, in order to ensure that the coupling member 200 and the drive transmission member 300 can be properly engaged with each other, the time period in which the rotary 102 rotates at the second speed is preferably set longer than or equal to the time required for the coupling member 200 to engage with the drive transmission member 300.

In the third embodiment, the coupling member 200 according to the first embodiment is used so that the coupling member 200 can be brought into engagement with the already-rotating drive transmission member 300 in the main apparatus body.

In the third embodiment, the time period required for the engagement is set to 230 msec, like the first embodiment, and the time period for moving from the position preceding the development position by 7° to the development position (i.e., the contact position) is set to about 230 msec. By performing such control, the same advantages as the first embodiment can be achieved.

Although the coupling member 200 in the above embodiments uses the pins 302*a* and 302*b* and the claws 201*a* and 201*b*, the invention is not limited to this example. As long as the coupling member 200 is engageable at a position preceding the development position, the coupling member 200 can be properly engaged with the drive transmission member 300 by temporarily stopping the rotary 102 or reducing the rotating speed of the rotary 102.

Accordingly, each of the above embodiments can provide a rotary-type image forming apparatus that allows for good image quality as well as a smaller main apparatus body and lower costs.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-220332 filed Aug. 28, 2008, and No. 2009-190451 filed Aug. 19, 2009, which are hereby incorporated by reference herein in their entirety.

What is claimed is:

1. An image forming apparatus comprising:

a rotatable image bearing member;

a plurality of developing devices each having a rotatable toner bearing member, the toner bearing member being arranged to come into contact with a surface of the image bearing member and supply toner to an electrostatic latent image formed on the surface;

a rotatable developing-device support member arranged to integrally support the plurality of developing devices and rotate so as to cause the toner bearing members to sequentially come into and out of contact with the surface of the image bearing member;

a drive transmission member provided in a main apparatus body and arranged to transmit a rotational driving force to each toner bearing member so as to rotate the toner bearing member;

a coupling member provided in each developing device and arranged to engage with the drive transmission member so as to transmit the rotational driving force from the drive transmission member to the toner bearing member, wherein the drive transmission member and the coupling member are engageable with each other before the toner bearing member comes into contact with the surface of the image bearing member; and a control device arranged to control the rotation of the developing-device support member such that, when the toner bearing member is to be brought into contact with the image bearing member by rotating the developing-device support member, the control device temporarily stops the rotation of the developing-device support member at a position where the coupling member and the drive transmission member are engageable with each other, allows the coupling member and the drive transmission member to engage with each other so that the toner bearing member is set in a rotating state, and subsequently rotates the developing-device support member so as to bring the toner bearing member into contact with the surface of the image bearing member.

2. An image forming apparatus according to claim 1, wherein a time period in which the rotation of the developing-device support member is temporarily stopped at the position where the coupling member and the drive transmission member are engageable with each other before the toner bearing member is brought into contact with the surface of the image bearing member is at least longer than or equal to a time period required for the coupling member to engage with the drive transmission member.

3. An image forming apparatus according to claim 1, wherein the drive transmission member includes a drive shaft arranged to be rotationally driven, and a protrusion provided on an outer periphery of the drive shaft, wherein a claw provided in the coupling member engages with the protrusion before the toner bearing member is brought into contact with the surface of the image bearing member so that the toner bearing member is set in the rotating state before the toner bearing member comes into contact with the surface of the image bearing member.

4. An image forming apparatus comprising:

a rotatable image bearing member;

a plurality of developing devices each having a rotatable toner bearing member, the toner bearing member being arranged to come into contact with a surface of the image bearing member and supply toner to an electrostatic latent image formed on the surface;

a rotatable developing-device support member arranged to integrally support the plurality of developing devices and rotate so as to cause the toner bearing members to sequentially come into and out of contact with the surface of the image bearing member;

a drive transmission member provided in a main apparatus body and arranged to transmit a rotational driving force to each toner bearing member so as to rotate the toner bearing member;

a coupling member provided in each developing device and arranged to engage with the drive transmission member so as to transmit the rotational driving force from the drive transmission member to the toner bearing member, wherein the drive transmission member and the coupling member are engageable with each other before the toner bearing member comes into contact with the surface of the image bearing member; and a control device arranged to control the rotation of the developing-device support member such that, when the toner bearing member is to be brought into contact with the image bearing member by rotating the developing-device support member, the control device rotates the developing-device support member at a first speed before the coupling member and the drive transmission member reach an engageable position and rotates the developing-device support member at a second speed, which is lower than the first speed, when the coupling member and the drive transmission member are at the engageable position, then allows the coupling member and the drive transmission member to engage with each other so that the toner bearing member is set in a rotating state, and subsequently rotates the developing-device support member so as to bring the toner bearing member into contact with the surface of the image bearing member.

5. An image forming apparatus according to claim 4, wherein a time period in which the developing-device support member is rotated at the first speed is at least longer than or equal to a time period required for the coupling member to engage with the drive transmission member.

6. An image forming apparatus according to claim 4, wherein the drive transmission member includes a drive shaft arranged to be rotationally driven, and a protrusion provided on an outer periphery of the drive shaft, wherein a claw provided in the coupling member engages with the protrusion before the toner bearing member is brought into contact with the surface of the image bearing member so that the toner bearing member is set in the rotating state before the toner bearing member comes into contact with the surface of the image bearing member.

* * * * *